US009290986B2

(12) United States Patent
Kotowski et al.

(10) Patent No.: US 9,290,986 B2
(45) Date of Patent: Mar. 22, 2016

(54) INSULATING GLAZING HAVING A PRESSURE-EQUALIZING ELEMENT

(71) Applicant: SAINT-GOBAIN GLASS FRANCE, Courbevoie (FR)

(72) Inventors: Guenther Kotowski, Eschweiler (DE); Katrin Frank, Aachen (DE); Walter Schreiber, Aachen (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 0 days.

(21) Appl. No.: 14/652,784

(22) PCT Filed: Aug. 20, 2013

(86) PCT No.: PCT/EP2013/067278

§ 371 (c)(1),
(2) Date: Jun. 16, 2015

(87) PCT Pub. No.: WO2014/095097

PCT Pub. Date: Jun. 26, 2014

(65) Prior Publication Data

US 2015/0322708 A1 Nov. 12, 2015

(30) Foreign Application Priority Data

Dec. 20, 2012 (EP) ..... 12198381

(51) Int. Cl.
*E06B 3/663* (2006.01)
*E06B 3/58* (2006.01)
(Continued)

(52) U.S. Cl.
CPC ..... *E06B 3/677* (2013.01); *E06B 3/6612* (2013.01); *E06B 3/66304* (2013.01); *E06B 3/64* (2013.01); *E06B 3/66342* (2013.01); *E06B 3/66352* (2013.01); *E06B 2003/6638* (2013.01)

(58) Field of Classification Search
CPC ..... E06B 3/677; E06B 3/66; E06B 3/6612; E06B 3/66034; E06B 3/663; E06B 3/58; E06B 3/66342; E06B 3/64; E06B 2003/6638; E06B 3/66304; E06B 3/66352; E06B 5/10
USPC ..... 52/218, 204.591, 204.593, 204.597, 52/204.595, 786.13, 1, 232
See application file for complete search history.

(56) References Cited

U.S. PATENT DOCUMENTS

| | | | | |
|---|---|---|---|---|
| 4,607,468 | A | 8/1986 | Paquet | |
| 4,831,799 | A | 5/1989 | Glover et al. | |
| 8,112,860 | B2 * | 2/2012 | Collins | E06B 3/677 29/402.01 |

(Continued)

FOREIGN PATENT DOCUMENTS

| | | | |
|---|---|---|---|
| DE | 3808907 | A1 | 10/1989 |
| DE | 4024697 | A1 | 2/1992 |

(Continued)

OTHER PUBLICATIONS

PCT International Search Report issued for PCT Application PCT/EP2013/067278 filed on Aug. 20, 2013 in the name of Saint-Gobain Glass France. Mail date: Sep. 26, 2013 (English Translation+ German Original).

(Continued)

*Primary Examiner* — Phi A
(74) *Attorney, Agent, or Firm* — Steinfl & Bruno LLP

(57) ABSTRACT

An insulating glazing is described, including a first pane, a second pane, and a circumferential spacer between the first and second panes. The spacer includes a hollow main body, two parallel pane contact walls, an outer wall, a glazing interior wall and a bore opening through the outer wall. The glazing further includes a hollow pressure-equalizing body, having a surrounding outer wall and a gas-permeable and vapor-diffusion-tight membrane fastened inside the outer wall. The pressure-equalizing body and a sealing compound are arranged in an outer pane intermediate space between the first pane and the second pane. The pressure-equalizing body is connected to the spacer through the bore opening, wherein a sealing material is arranged between the bore opening and the outer wall of the pressure-equalizing body. The hollow main body of the spacer contains a desiccant and at least one partition wall.

19 Claims, 9 Drawing Sheets

Figure 1:
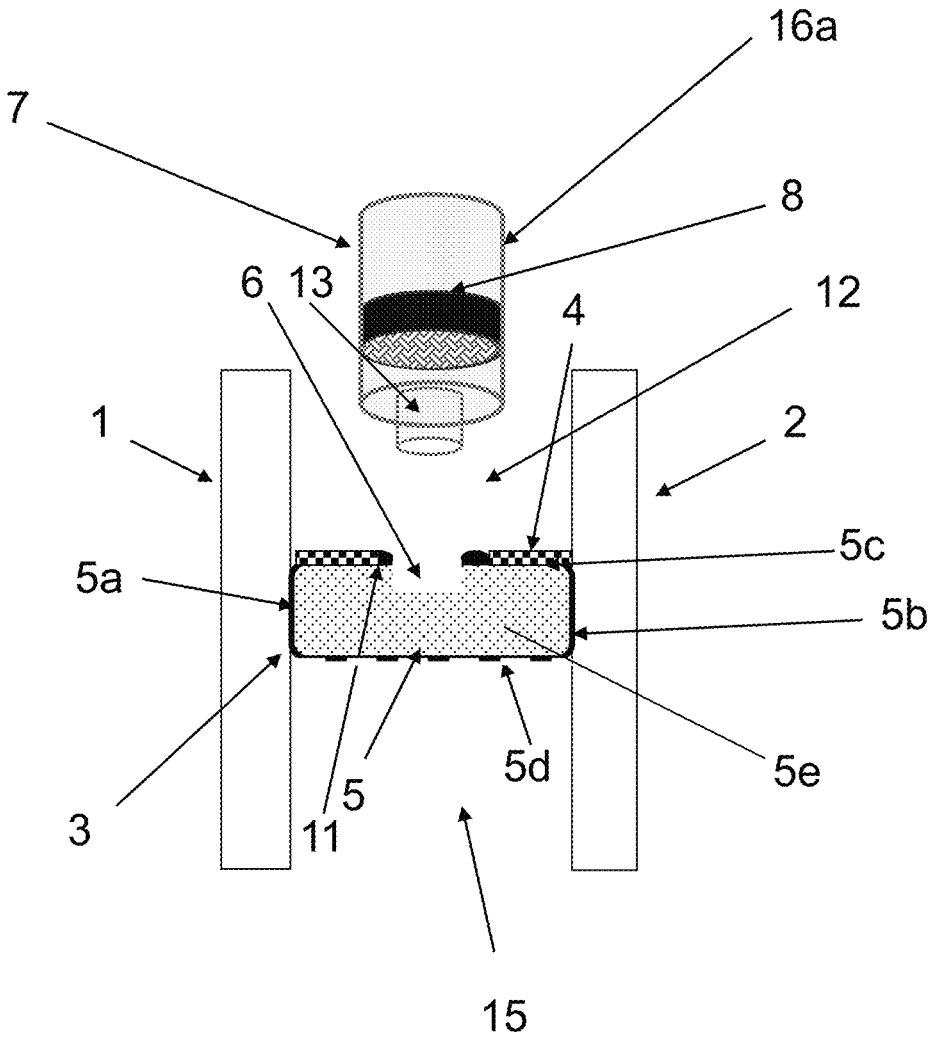

(51) Int. Cl.

| | |
|---|---|
| ***E06B 3/677*** | (2006.01) |
| ***E06B 3/66*** | (2006.01) |
| *E06B 3/64* | (2006.01) |

(56) References Cited

U.S. PATENT DOCUMENTS

| | | | | |
|---|---|---|---|---|
| 2011/0133940 | A1* | 6/2011 | Margalit | E06B 3/66366 340/584 |
| 2011/0296796 | A1* | 12/2011 | Lenhardt | E06B 3/66342 52/786.13 |
| 2014/0220268 | A1* | 8/2014 | Dreux | E06B 3/6775 428/34 |
| 2015/0343743 | A1* | 12/2015 | Nea | E06B 3/66342 428/34 |

FOREIGN PATENT DOCUMENTS

| | | | |
|---|---|---|---|
| DE | 19625845 | A1 | 1/1998 |
| DE | 102005002285 | A1 | 7/2006 |
| EP | 0261923 | A2 | 3/1988 |
| EP | 0852280 | A1 | 7/1998 |
| EP | 2006481 | A2 | 12/2008 |
| FR | 2552153 | A1 | 3/1985 |
| JP | H0626282 | A | 2/1994 |
| WO | 01/65047 | A1 | 9/2001 |

OTHER PUBLICATIONS

PCT Written Opinion issued for PCT Application PCT/EP2013/067278 filed on Aug. 20, 2013 in the name of Saint-Gobain Glass France. Mail date: Sep. 26, 2013 (English Translation+ German Original).

PCT International Preliminary Report on Patentability issued for PCT Application PCT/EP2013/067278 filed on Aug. 20, 2013 in the name of Saint-Gobain Glass France. Mail date: Jun. 23, 2015 (English Translation+ German Original).

* cited by examiner

INSULATING GLAZING HAVING A PRESSURE-EQUALIZING ELEMENT

CROSS REFERENCE TO RELATED APPLICATIONS

The present application is the U.S. national stage of International Patent Application PCT/EP2013/067278, filed internationally on Aug. 20, 2013, which, in turn, claims priority to European Patent Application No. 12198381.1, filed on Dec. 20, 2012.

The invention relates to an insulating glazing having a pressure-equalizing element, a method for its production, and its use.

The thermal conductivity of glass is lower by roughly a factor of 2 to 3 than that of concrete or similar building materials. However, since in most cases glass panes are designed significantly thinner than comparable elements made of stone or concrete, buildings nevertheless frequently lose the largest share of heat via the external glazing. This effect is particularly significant in high-rise buildings with partial or complete glass façades. The necessary additional costs for heating and air conditioning systems constitute a part of the maintenance costs of a building which is not to be underestimated. In addition, in the wake of stricter building codes, lower carbon dioxide emissions are required. Insulating glazings are an important approach to a solution for this. Especially in the wake of ever increasing prices of raw materials and ever stricter environmental requirements, building construction can no longer do without insulating glazings. Consequently, insulating glazings constitute an increasingly greater part of the outward directed glazings. Insulating glazings usually include at least two panes of glass or polymeric materials. The panes are separated from each other by a gas or vacuum space defined by a spacer. The thermal insulation capacity of insulating glass is significantly higher than that of single pane glass and can be even further increased and improved in triple glazings or with special coatings. Thus, for example, silver-containing coatings enable decreased transmittance of infrared radiation and thus reduce the cooling of a building in the winter. In addition to the important property of thermal insulation, optical and aesthetic characteristics also increasingly play an important role.

In particular, in the case of buildings with a large area external glass façade, the insulating action plays an important role not merely for reasons of cost. Since the thermal insulation of very thin glass is usually inferior compared to masonry, improvements are necessary in this area.

In addition to the type and structure of the glass, the other components of an insulating glazing are also of great significance. The sealing and especially the spacer have a great influence on the quality of the insulating glazing.

Especially the contact points between the spacer and the glass pane are very susceptible to temperature and climate fluctuations. The connection between the pane and the spacer is produced by an adhesive connection made of an organic polymer, for example, polyisobutylene. In addition to the direct effects on the physical properties of the adhesive connection, the glass itself, in particular, acts on the adhesive connection. Because of the temperature changes, for example, the glass expands from solar irradiation or contracts again upon cooling. This mechanical movement simultaneously expands or compresses the adhesive connection which can compensate for these movements only to a limited extent through its own elasticity. During the course of the service life of the insulating glazing, the mechanical stress described can mean a partial or full-surface detachment of the adhesive connection. This detachment of the adhesive connection can then allow penetration of air moisture inside the insulating glazing. These climatic loads can result in condensation in the area of the window panes and a decrease in the insulating effect.

DE 40 24 697 A1 discloses a water-tight multipane insulating glazing comprising at least two glass panes and a profile spacer. The sealing is done by polyvinylidene chloride films or coatings on the spacer. In addition, the edge bonding can be done using a solution containing polyvinylidene chloride.

EP 0 852 280 A1 discloses a spacer for multipane insulating glazings. The spacer includes a metal foil on the bonding surface and glass fiber content in the plastic of the basic body.

DE 196 25 845 A1 discloses an insulating glazing with a spacer made of thermoplastic olefins. The spacer has water vapor permeability of less than 1 g mm/mm$^2$-d as well as high tensile strength and Shore hardness. Moreover, the spacer includes a gas-tight film as a water vapor barrier.

EP 0 261 923 A2 discloses a multipane insulating glazing with a spacer made of a moisture permeable foam with an integrated desiccant. The arrangement is preferably sealed by an external seal and a gas- and moisture-tight film. The film can contain metal-coated PET and polyvinylidene chloride copolymers.

DE 38 08 907 A1 discloses a a multi-ply glass pane with a ventilation channel running through the edge bond and a drying chamber filled with a desiccant.

DE 10 2005 002 285 A1 discloses an insulating glass pressure-equalizing system for use in the space between the panes of thermal insulating glazings.

EP 2 006 481 A2 discloses a device for pressure equalization for insulating glazings with enclosed gas volumes, a pressure-equalizing valve is introduced into the spacer of the insulating glazing. Such pressure-equalizing valves have, however, complex mechanics in the form of multiple movable parts which cause not only an elevated susceptibility of the system to errors but also significantly higher production costs. The relatively long pressure-equalizing times of these insulating glazing systems are another disadvantage. Thus, before delivery of the glazing, extended storage is required compared to systems without pressure equalization. Moreover, only an exchange of limited volumes is possible using pressure-equalizing valves with multiple valves being required, in particular with large panes, and each additional valve means a weakening of the system and additional production expense.

Leaks inside the spacer can easily result in a loss of an inert gas between the insulating glazings. Depending on the distance between the panes of the insulating glazing, different noble gases or even air can, for example, be used. In addition to an inferior insulation effect, this can also easily result in penetrating moisture in the insulating glazing. Precipitation between the panes of the insulating glazing formed by moisture thus quite substantially degrades the optical quality and, in many cases, necessitates a replacement of the entire insulating glazing. However, at the same time, a very tight insulating glazing is vulnerable to air pressure or temperature fluctuations. Large pressure differences are also associated with large temperature fluctuations, for example, in the case of changing solar irradiation. These pressure differences can lead to deformations of the insulating glazing itself or even its frame. These deformations negatively affect the service life and the leakproofness of the adhesive connection between the glass panes and the spacer of the insulating glazing.

The object of the invention consists in providing an insulating glazing which enables an improved, durably stable insulating effect without deformation of the panes without a decrease in the sealing action (aging) of the adhesive connection between the glass panes and the spacer with, at the same time, simple assembly.

The object of the present invention is accomplished according to the invention by an insulating glazing according to the independent claim 1. Preferred embodiments are evident from the subclaims.

A method for producing the insulating glazing according to the invention and its use according to the invention are evident from other independent claims.

The insulating glazing according to the invention having a pressure-equalizing body comprises at least a first pane and second pane. A circumferential spacer is situated between the first pane and the second pane and is preferably attached by adhesive bonding between the spacer and the panes. The spacer includes at least a hollow main body with at least two parallel pane contact walls, an outer wall with a gas-tight insulating layer, and a glazing interior wall.

As a main body, all hollow body profiles known according to the prior art can be used regardless of their material composition. Mentioned here by way of example are polymeric or metallic main bodies.

Polymeric main bodies preferably include polyethylene (PE), polycarbonates (PC), polypropylene (PP), polystyrene, polybutadiene, polynitriles, polyesters, polyurethanes, polymethyl methacrylates, polyacrylates, polyamides, polyethylene terephthalate (PET), polybutylene terephthalate (PBT), particularly preferably acrylonitrile-butadiene-styrene (ABS), acrylester-styrene-acrylonitrile (ASA), acrylonitrile-butadiene-styrene—polycarbonate (ABS/PC), styrene-acrylonitrile (SAN), PET/PC, PBT/PC, and/or copolymers or mixtures thereof. Polymeric main bodies can optionally also include other components, such as, for example, glass fibers. The polymeric materials used are, as a rule, gas-permeable, such that if this permeability is undesirable, additional measures must be taken.

Metallic main bodies are preferably made of aluminum or stainless steel and have no gas permeability.

The main body has a hollow chamber.

In an advantageous embodiment, the walls of the main body are gas-permeable. Regions of the main body in which such permeability is undesirable can, for example, be sealed with a gas-tight insulating layer. Especially polymeric main bodies are used in combination with such a gas-tight insulating layer.

In another preferred embodiment, the main body is gas-impermeable, with permeability being obtainable, for example, through the introduction of openings. Particularly in the case of metallic main bodies whose wall is not gas-permeable, openings are introduced to the extent necessary to obtain gas permeability. The total number of openings depends on the size of the insulating glazing. The openings connect the hollow chamber to the interior of the insulating glazing, by which means a gas exchange between them becomes possible. The openings are preferably implemented as slits, particularly preferably as slits with a width of 0.2 mm and a length of 2 mm.

The insulating glazing according to the invention further includes a hollow pressure-equalizing body with a gas-permeable and vapor-diffusion-tight membrane fastened therein. The pressure-equalizing body includes an outer wall. The outer wall can be implemented as a cylindrical surface or as surfaces connected by corners and surrounds the hollow pressure-equalizing body. The vapor-diffusion-tight membrane is fastened in the hollow pressure-equalizing body such that the gas exchange inside the pressure-equalizing body must take place through the membrane. The membrane is designed such that gases, preferably gases of the air can pass through the membrane and water vapor is retained. The pressure-equalizing body and a sealing compound are arranged in an outer pane intermediate space between the first pane and the second pane. The sealing compound fills the outer pane intermediate space and surrounds the pressure-equalizing body.

The insulating glazing according to the invention having a pressure-equalizing body is an open system wherein the pressure-equalizing body includes no valve and no moving parts.

Pressure-equalizing valves have the disadvantage that only a specific volume can be exchanged, and in the case of large panes, multiple valves are necessary. The pressure-equalizing body according to the invention is, on the contrary, economical and can be integrated into any hollow profile spacers. In a preferred embodiment, the pressure-equalizing body includes a sleeve (outer wall) and a membrane introduced therein; the pressure-equalizing body particularly preferably consists of these two components. The sleeve serves to fix the membrane in a suitable position. The sleeve is gas-impermeable such that an exchange of air can occur only via the membrane. Since the pressure-equalizing body according to the invention includes no mechanical components, it is extremely durable.

The pressure-equalizing body is connected to the spacer via a bore opening through the insulating layer as well as the outer wall. A sealing means, for example, butyl (polyisobutylene/PIB) air tightly seals the gap between the outer wall of the pressure-equalizing body with the spacer. Due to the gas-tight insulating layer, a gas exchange with the atmosphere is only possible via the pressure-equalizing body. In this manner, a defined pressure and temperature equalization between the insulating glazing and the environment is possible. The sealing means, in particular butyl, improves the seal and strength of the pressure-equalizing body.

The hollow main body contains a desiccant, preferably silica gel, $CaCl_2$, $Na_2SO_4$, activated carbon, silicates, bentonites, zeolites, and/or mixtures thereof, particularly preferably molecular sieves. This desiccant is preferably introduced into the hollow chamber of the main body. Thus, absorption of air moisture by the desiccant is permitted and condensation on the panes is prevented.

The hollow main body has one or a plurality of partition walls. The partition walls limit direct gas flow through the main body. The partition walls enable a variation of the main body space that is in direct contact with the pressure-equalizing body.

In a possible embodiment, the main body has a partition wall that is preferably arranged adjacent the pressure-equalizing body. A gas exchange through the partition wall is not possible such that a flow of gas through the pressure-equalizing body can run through the main body only in one direction.

The glazing interior wall of the spacer includes a permeable region, which gas-permeably connects the hollow chamber of the main body to the interior of the insulating glazing. Thus, an air and moisture exchange between these two gas spaces is possible.

The permeable region of the glazing interior wall has one or a plurality of openings and/or a gas-permeable wall that enable a gas exchange.

The glazing interior surface further has a gas-impermeable region. In a possible embodiment, a second gas-tight insulating layer is mounted on the glazing interior wall in this gas-impermeable region. In another advantageous embodiment, the glazing interior wall has a gas-tight wall.

Preferably, the gas-impermeable region is located between the pressure-equalizing body and a permeable region. If the spacer has a partition wall, the pressure-equalizing body is thus located between the partition wall and the gas-impermeable region, with the pressure-equalizing body being mounted adjacent the partition wall and the glazing interior surface situated between the pressure-equalizing body and the partition wall also being gas impermeable. A stream of air entering through the pressure-equalizing body thus flows along the gas-impermeable region of the spacer and and then enters into the interior of the insulating glazing in the next permeable region. The stream of air passes the desiccant introduced into the hollow chamber of the spacer. Inside the gas-impermeable region of the spacer, an air exchange between the hollow chamber and the interior of the glazing is prevented. Thus, the stream of air is first pre-dried in the gas-impermeable region of the spacer before it enters the glazing interior. Thus, the long-term stability as well as the insulating action can be further improved, by which means a longer service life of the glazing is obtained. According to standards customary in the industry, in the production of insulating glazings, a dewpoint reduction to −30° C. should be reached already 24 hours after production such that the product can be delivered already shortly after production. However, insulating glazings known according to the prior art with pressure-equalizing systems, such as pressure-equalizing valves do not meet this standard such that relatively long storage associated with costs occurs. On the contrary, the insulating glazing according to the invention having a pressure-equalizing body meets this standard and reaches the desired dewpoint reduction to −30° C. within 24 hours.

The length d of the gas-impermeable region, measured along the circumferential spacer is preferably at least 0.2 U, where U is the circumference of the spacer along the glazing interior wall. Preferably, $d \geq 0.3$ U, particularly preferably $d \geq 0.5$ U. Thus, the drying path of the stream of air in the gas-impermeable region is increased such that the long-term stability, insulating action, and service life of the glazing are further optimized.

For the selective control of the gas flow through the main body, multiple alternating permeable regions and gas-impermeable regions can be introduced into the glazing interior wall. In a preferred embodiment, one gas-impermeable region and one permeable region are present, with the gas-impermeable region adjacent the pressure-equalizing body.

The glazing interior wall includes, preferably partially or in sections, a second gas-tight insulating layer. In this manner, the gas flow inside the gas-permeable main body can be preset, controlled, and regulated. In the context of the invention, the expression "second gas-tight insulating layer" also includes a section of the glazing interior wall that is not gas-permeable. Preferably, 5% to 50% of the glazing interior wall is covered or coated with the second gas-tight insulating layer. This region of the glazing interior wall coated with the gas-tight insulating layer forms the gas-impermeable region. Alternatively, this can, for example, also be realized by a non-perforated gas-impermeable region of the glazing interior wall.

In a possible embodiment, the gas-tight insulating layer and/or the second gas-tight insulating layer contain iron, aluminum, silver, copper, gold, chromium, and/or alloys or mixtures thereof. The metallic layer preferably has a thickness from 10 nm to 200 nm.

The hollow pressure-equalizing body is preferably connected to the bore opening via a narrow part. The narrow part facilitates the insertion of the pressure-equalizing body into the bore opening and improves the sealing action of the sealing means such as, for example, a butyl cord.

The sealing compound preferably contains organic polysulfides, silicones, RTV (room temperature vulcanizing) silicone rubber, HTV (high temperature vulcanizing) silicone rubber, peroxide vulcanizing silicone rubber, and/or addition vulcanizing silicone rubber, polyurethanes, butyl rubber, and/or polyacrylates. In an optional embodiment, additions to increase aging resistance, for example, UV stabilizers, can also be included.

In a preferred embodiment, the sleeve (outer wall) of the pressure-equalizing body contains metals or gas-tight plastics, preferably aluminum, polyethylene vinyl alcohol (EVOH), lower density polyethylene (LDPE), and/or biaxially oriented polypropylene film (BOPP), particularly preferably polyethylene vinyl alcohol.

In an alternative embodiment, the sleeve (outer wall) of the pressure-equalizing body preferably contains elastomers, preferably rubber, particularly preferably vulcanized polyisoprenes, RTV (room temperature vulcanizing) silicone rubber, HTV (high temperature vulcanizing) silicone rubber, peroxide vulcanized silicone rubber, and/or addition vulcanized silicone rubber, butyl rubber, and/or mixtures thereof.

The sealing means preferably includes butyl (polyisobutylene (PIB)), preferably as butyl cord. Butyl enables a durably stable and well-formable seal of the intermediate space between the pressure-equalizing body and the spacer.

The invention further comprises a method for producing an insulating glazing having pressure-equalization, wherein a spacer is provided on the outer wall with a gas-tight insulating layer. The spacer includes a hollow main body with two parallel pane contact walls, an outer wall, and a glazing interior wall. The spacer receives, in the next step, a bore opening through the outer wall. The spacer is then arranged together with an adhesive layer between a first pane and a second pane. In the following step, a hollow pressure-equalizing body with a gas-permeable and vapor-diffusion-tight membrane fastened therein is fastened in or on the bore opening. In a preferred embodiment, a sealing means, for example, polyisobutylene, is arranged between the bore opening and the outer wall of the pressure-equalizing body. An outer pane intermediate space between the first pane, the second pane, the hollow pressure-equalizing body, and the spacer is then filled with a sealing compound, for example, polyurethane or polysulfide.

The hollow pressure-equalizing body is preferably provided with a removable stopper, preferably a rubber stopper. The rubber stopper must be removed again after the production of the insulating glazing in order to enable pressure-equalization according to the invention via the pressure-equalizing body. The rubber stopper prevents soiling of the pressure-equalizing body during the production of the insulating glazing.

A butyl cord is preferably arranged between the pressure-equalizing body and the bore opening as a sealing means. Butyl enables a durably stable and well-formable sealing of the intermediate space between the pressure-equalizing body and the gas-tight insulating layer.

The invention further comprises the use of the insulating glazing according to the invention as building interior glazing, building exterior glazing, and/or façade glazing.

Figure 2:
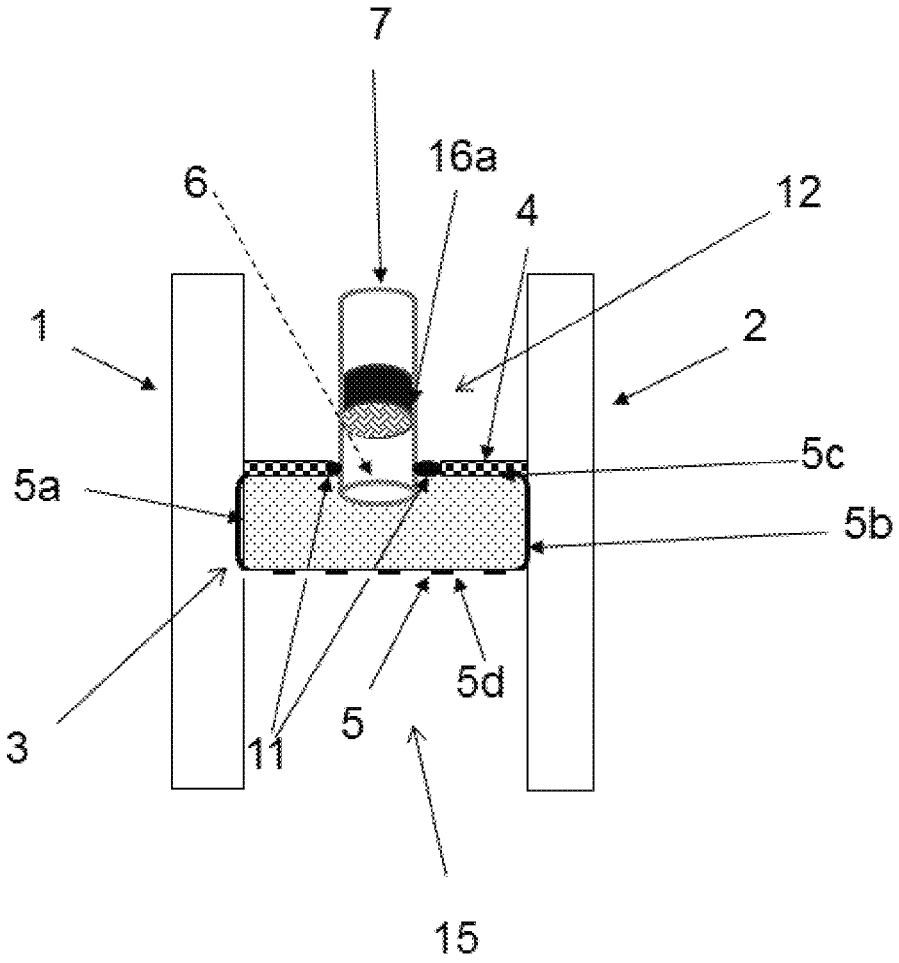
Figure 3:
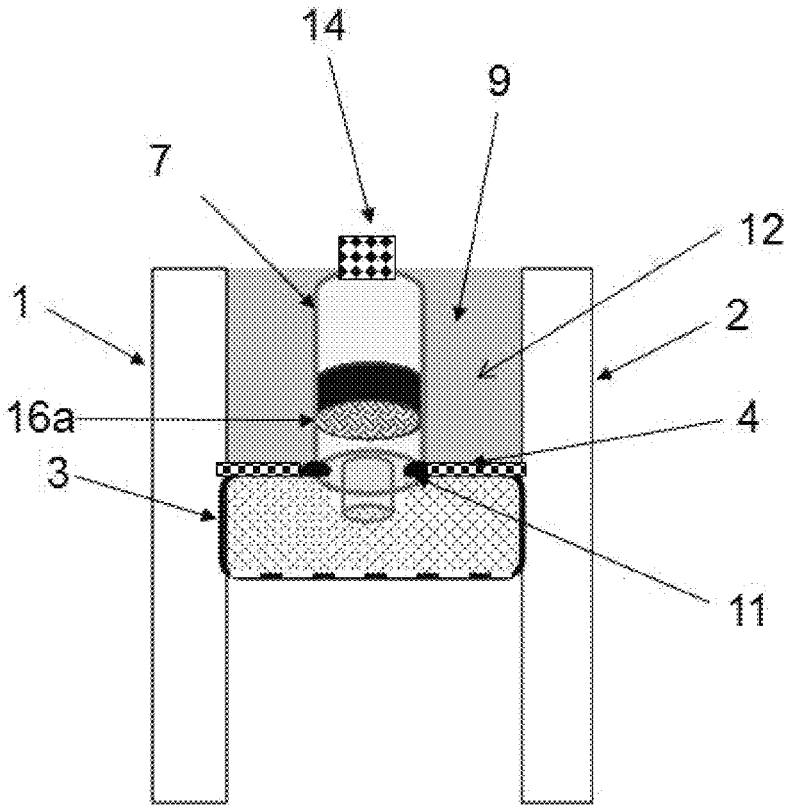
Figure 4:
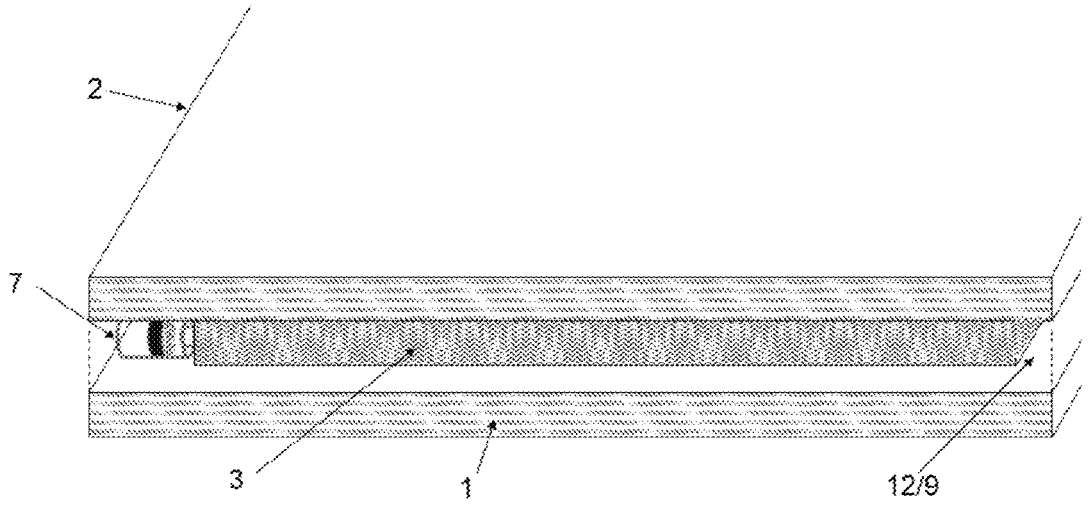
Figure 5A:
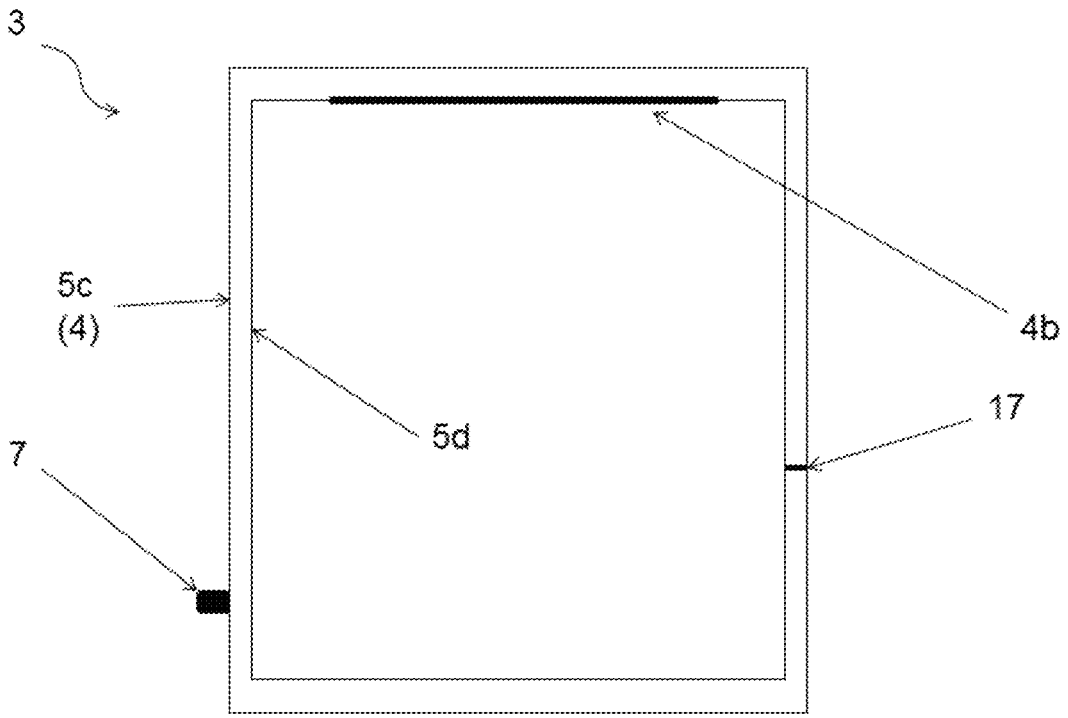
Figure 5B:
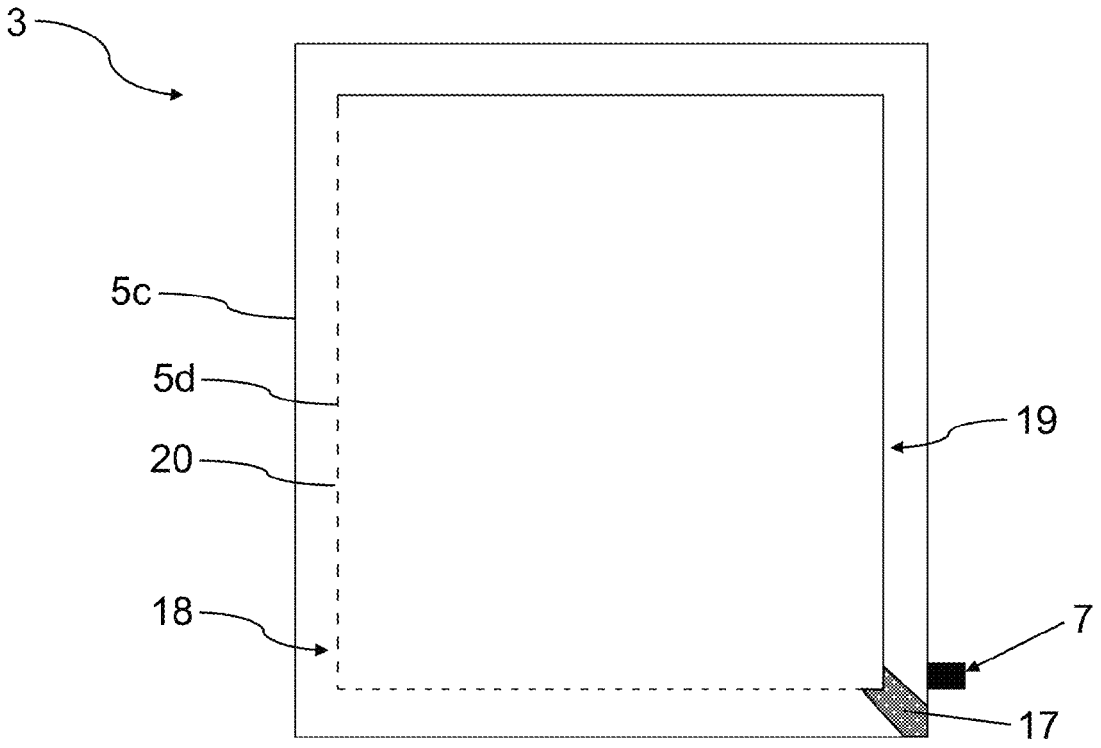
Figure 5C:
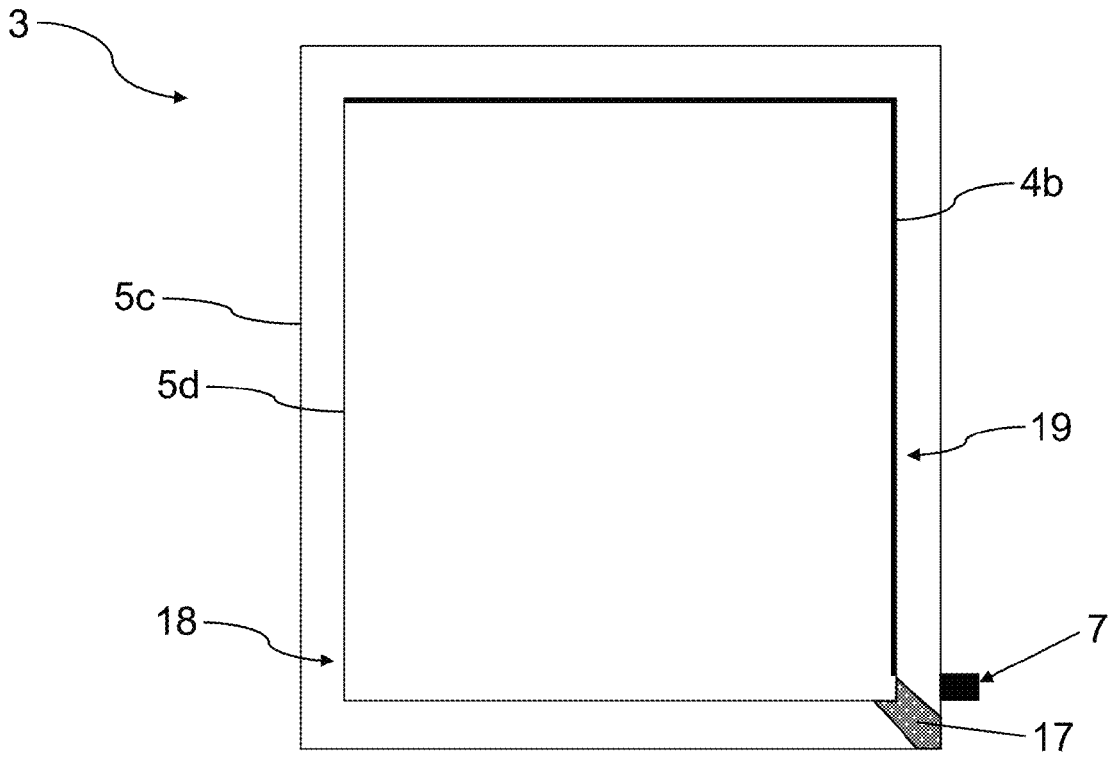
Figure 6A:
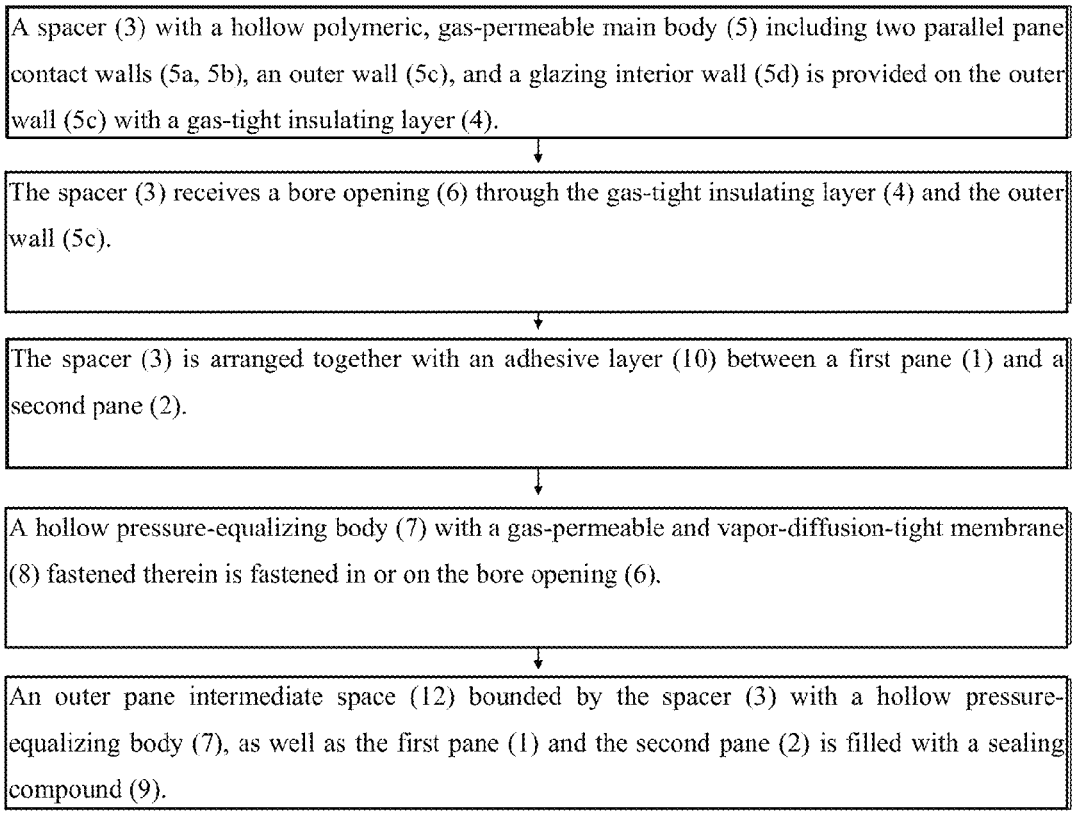
Figure 6B:
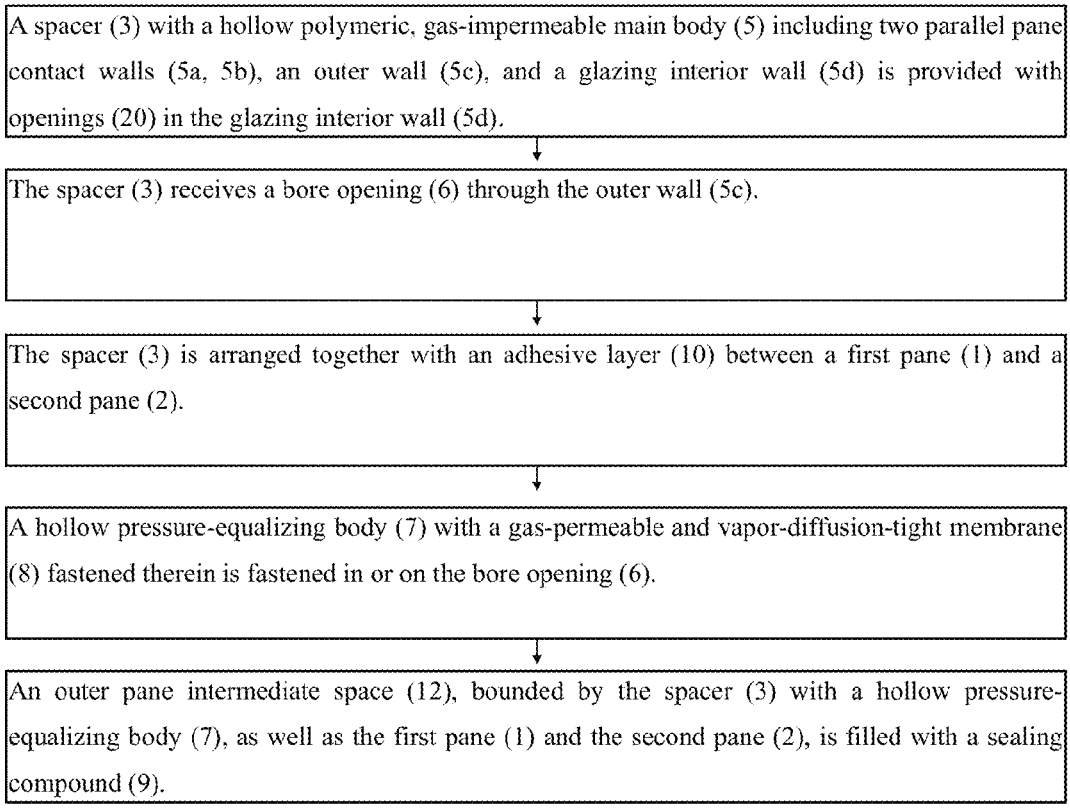

In the following, the invention is explained in detail with reference to drawings. The drawings are purely schematic representations and are not true to scale. They in no way restrict the invention. The drawings depict:

FIG. 1 a schematic cross-section of the edge region of the insulating glazing according to the invention, FIG. 2 another schematic cross-section of the edge region of the insulating glazing according to the invention, FIG. 3 a cross-section of the edge region of the insulating glazing according to the invention after completion, FIG. 4 a schematic side view of the insulating glazing according to the invention, FIG. 5*a* a schematic view of the spacer according to the invention, FIG. 5*b* a schematic view of another embodiment of the spacer according to the invention, FIG. 5*c* a schematic view of another embodiment of the spacer according to the invention, FIG. 6*a* a flowchart of a possible embodiment of the method for producing the insulating glazing according to the invention, and FIG. 6*b* a flowchart of another embodiment of the method for producing the insulating glazing according to the invention.

FIG. 1 depicts a schematic cross-section of the edge region of the insulating glazing according to the invention. A spacer (3) is arranged between a first pane (1) and a second pane (2). The spacer (3) includes a hollow main body (5) with at least two parallel pane contact walls (5*a*, 5*b*), an outer wall (5*c*) with a gas-tight insulating layer (4), a glazing interior wall (5*d*), and a hollow chamber (5*e*). The main body (5) is made of a gas-permeable polymer. The glazing interior wall (5*d*) is implemented at least partially gas-permeable. A gas-tight insulating layer (4) is arranged on the outer wall (5*c*). This gas-tight insulating layer (4) prevents gas exchange between the spacer (3) and, thus, the interior (15) of the insulating glazing. The outer wall (5*c*) has a bore opening (6) through the insulating layer (4) as well as the outer wall (5*c*). A hollow pressure-equalizing body (7) with a gas-permeable and vapor-diffusion-tight membrane (8) fastened therein is connected to the spacer (3) via the bore opening (6). The hollow pressure-equalizing body (7) includes a surrounding outer wall (16*a*). A narrow part (13) and a surrounding sealing means (11) enable a very leakproof connection of the spacer (3) to the outer wall (16*a*) of the pressure-equalizing body (7). The vapor-diffusion-tight membrane, preferably semipermeable membrane (8) permits pressure equalization between the interior (15) of the insulating glazing and the outside atmosphere. This pressure equalization substantially reduces the bending of the panes (1, 2) of the insulating glazing otherwise occurring as a function of the outside temperature, without the possibility of penetration of appreciable moisture.

FIG. 2 depicts another schematic cross-section of the edge region of the insulating glazing according to the invention. The basic structure corresponds to that described in FIG. 1. In this depiction, the pressure-equalizing body (7) is arranged directly in the bore opening (6). A surrounding sealing means (11) enables an airtight connection of the spacer (3) to the outer wall (16*a*) of the pressure-equalizing body (7).

FIG. 3 depicts a cross-section of the edge region of the insulating glazing according to the invention after completion. The basic structure corresponds to that described in FIG. 1. A spacer (3) is arranged between a first pane (1) and a second pane (2). An outer pane intermediate space (12) is filled with a sealing compound (9), for example, organic polysulfide. A hollow pressure-equalizing body (7) is connected to the spacer (3) via the bore opening (6). The pressure-equalizing body (7) has a stopper (14) that is removed after the assembly or installation of the insulating glazing. This stopper (14) prevents the soiling of the pressure-equalizing body (7).

FIG. 4 depicts a schematic side view of the insulating glazing according to the invention. A spacer (3) is arranged between a first pane (1) and a second pane (2). The spacer (3) is, as described in FIGS. 1 and 2, connected to a pressure-equalizing body (7). An outer pane intermediate space (12) is filled with a sealing compound (9) (not shown).

FIG. 5*a* depicts a schematic plan view of the spacer according to the invention (3), wherein gas-tight insulating layer (4) is not depicted. The glazing interior wall (5*d*) and the outer wall (5*c*) of the gas-permeable main body (5) are depicted. The pressure equalization inside the spacer (3) filled with desiccant is done as described above by the pressure-equalizing body (7). A single section of the glazing interior wall (5*d*) includes a second gas-tight insulating layer (4*b*). In the region of the second gas-tight insulating layer (4*b*), no gas and pressure equalization with a gas space situated between the (not shown) first pane (1), second pane (2), and the spacer (3) is possible. Additionally or alternatively, a gas-tight or partially gas-permeable partition wall (17) can be arranged in the spacer (3). The partition wall (17) or the second gas-tight insulating layer (4*b*) limit the direct gas flow through the hollow main body (5). This limitation enables a variation of the main body space that is in direct contact with the pressure-equalizing body (7). The partition wall (17) and the second gas-tight insulating layer thus enable adjustment of the pressure equalization inside the insulating glazing.

FIG. 5*b* depicts a schematic plan view of another embodiment of the spacer according to the invention (3). The glazing interior wall (5*d*) and the outer wall (5*c*) of the main body (5), between which the hollow chamber (5*e*) is situated, are depicted. The hollow chamber (5*e*) is filled with desiccant. The main body (5) is made of aluminum and is thus gas tight. A gas-tight partition wall (17) is introduced into the spacer (3). Adjacent the partition wall (17), a pressure-equalizing body (7) that protrudes through the outer wall (5*c*) into the hollow chamber (5*e*) is introduced. The section of the glazing interior wall (5*d*) adjacent the pressure-equalizing body (7) includes a gas-impermeable region (19) in which no gas and pressure equalization with the interior situated between the panes is possible. The length d of the gas-impermeable region (19), measured along the glazing interior wall (5*d*), corresponds to one-half the circumference U of the spacer (3) along the glazing interior wall (5*d*). A permeable region (18) of the glazing interior wall (5*d*) is situated adjacent the gas-impermeable region (19). In the permeable region (18), openings (20) that enable the gas exchange in this region between the hollow chamber (5*e*) and the interior are introduced into the glazing interior wall (5*d*). The openings (20) are implemented as slits with a width of 0.2 mm and a length of 2 mm. The slits ensure optimum air exchange without the desiccant being able to penetrate out of the hollow chamber (5*e*) into the interior of the glazing. The pressure equalization inside the spacer (3) filled with desiccant is done as already described by the pressure-equalizing body (7). A stream of air entering through the pressure-equalizing body (7) flows by the capillary action of the spacer (3) filled with desiccant first along the gas-impermeable region (19). In the process, the stream of air passes the desiccant introduced into the hollow chamber of the spacer, while, at the same time, an air exchange between the hollow chamber and the interior of the glazing is prevented. Thus, the stream of air is first pre-dried in the gas-impermeable region of the spacer, before it then enters, in the next permeable region, into the interior of the insulating glazing. Thus, the long-term stability as well as the insulating action can be further improved, by which means a longer service life of the glazing is obtained. Moreover, the insulating glazing meets the standards relative to a dewpoint reduction to −30° C. within 24 hours after production.

This effect was surprising and unexpected for the person skilled in the art.

FIG. 5*c* depicts a schematic plan view of another embodiment of the spacer according to the invention (3). The glazing interior wall (5*d*) and the outer wall (5*c*) of the main body (5), between which the hollow chamber (5*e*) is situated, are depicted. The hollow chamber (5*e*) is filled with desiccant. The main body (5) is made of a polymeric material and is gas-permeable. A gas-tight insulating film (4), not shown in this depiction, is situated on the outer wall (5*c*). A gas-tight partition wall (17) is introduced into the spacer (3). A pressure-equalizing body (7), which protrudes through the outer wall (5*c*) into the hollow chamber (5*e*), is introduced adjacent the partition wall (17). The section of the glazing interior wall (5*d*) bordering the pressure-equalizing body (7) includes a second gas-tight insulating layer (4*b*). This creates a gas-impermeable region (19) in which no gas and pressure equalization with the interior situated between the panes is possible. The length d of the gas-impermeable region (19), measured along the glazing interior wall (5*d*), corresponds to one-half the circumference U of the spacer (3) along the glazing interior wall (5*d*). A permeable region (18) of the glazing interior wall (5*d*) is situated adjacent the gas-impermeable region (19). Since the wall of the main body (5) is gas-permeable, it is unnecessary to provide additional openings in the glazing interior wall (5*b*); however, optionally, this is conceivable even with polymeric main bodies. The gas-permeable wall ensures optimal air exchange, without desiccant from the hollow chamber (5*e*) being able to penetrate into the interior of the glazing. The pressure equalization inside the spacer (3) filled with desiccant is done as described in FIG. 5*b*. The embodiment according to FIG. 5*c* also shows an improved service life of the glazing and meets the standards with regard to a dewpoint reduction to −30° C. within 24 hours after production.

This effect was surprising and unexpected for the person skilled in the art.

FIG. 6*a* depicts a flowchart of a possible embodiment of the method for producing the insulating glazing according to the invention. A spacer (3) arranged between two panes (1, 2) includes a hollow polymeric, gas-permeable main body (5) with two parallel pane contact walls (5*a*, 5*b*), an outer wall (5*c*) with a gas-tight insulating layer (4), and a glazing interior wall (5*d*). The spacer (3) receives, in the next step, a bore opening (6) through the gas-tight insulating layer (4) and the outer wall (5*c*). The spacer (3) is then arranged together with an adhesive layer (10) between a first pane (1) and a second pane (2). In the following step, a hollow pressure-equalizing body (7) with a gas-permeable and vapor-diffusion-tight membrane (8) fastened therein is fastened in or on the bore opening (6). An outer pane intermediate space (12) between the first pane (1), the second pane (2), the hollow pressure-equalizing body (7), and the spacer (3) is then filled with a sealing compound (9), for example, polyurethane or polysulfide. In a preferred embodiment, the hollow pressure-equalizing body (7) is provided with a stopper during the assembly of the insulating glazing. The stopper is removed again after completion of the insulating glazing and prevents, in particular, contamination of the hollow pressure-equalizing body (7) with the sealing compound (9).

FIG. 6*b* depicts a flowchart of another possible embodiment of the method for producing the insulating glazing according to the invention with a gas-impermeable main body (5). The basics of the method correspond to those described in FIG. 6*a*, with no insulating film (4) having to be applied on the gas-impermeable main body (5) to ensure leakproofness. Instead, in the first process step, openings (20) are introduced into the glazing interior wall (5*d*) and, thus, a permeable region (18) is produced. The further processing is done analogously to the method described in FIG. 6*a*.

LIST OF REFERENCE CHARACTERS (1) first pane
(2) second pane
(3) spacer
(4) gas-tight insulating layer
(4*b*) second gas-tight insulating layer
(5) hollow main body
(5*a*) pane contact wall
(5*b*) pane contact wall
(5*c*) outer wall
(5*d*) glazing interior wall
(5*e*) hollow chamber
(6) bore opening
(7) pressure-equalizing body
(8) vapor-diffusion-tight membrane
(9) sealing compound
(10) adhesive layer
(11) sealing means
(12) outer pane intermediate space
(13) narrow part (of the pressure-equalizing body)
(14) stopper
(15) interior (of the insulating glazing)
(16*a*) outer wall (of the pressure-equalizing body)
(17) partition wall
(18) permeable region
(19) gas-impermeable region
(20) openings

The invention claimed is:

1. An insulating glazing having a pressure-equalizing body, comprising:

a first pane and second pane;

a circumferential spacer between the first pane and the second pane, wherein the spacer includes a hollow main body with at least two parallel pane contact walls, an outer wall, and a glazing interior wall, and a bore opening through the outer wall; and a hollow pressure-equalizing body having a surrounding outer wall with a gas-permeable and vapor-diffusion-tight membrane fastened inside the pressure-equalizing body, wherein the pressure-equalizing body and a sealing compound are arranged in an outer pane intermediate space between the first pane and the second pane, wherein the pressure-equalizing body is connected to the spacer via the bore opening, wherein a sealing material is arranged between the bore opening and the outer wall of the pressure-equalizing body, wherein the hollow main body contains a desiccant, and wherein the hollow main body has at least one partition wall.

2. The insulating glazing according to claim 1, wherein the desiccant contains at least one of silica gel, $CaCl_2$, $Na_2SO_4$, activated carbon, silicates, bentonites, zeolites, and mixtures thereof.

3. The insulating glazing according to claim 1, wherein the desiccant contains molecular sieves.

4. The insulating glazing according to claim 1, wherein the partition wall is arranged adjacent the pressure-equalizing body.

5. The insulating glazing according to claim 1, wherein the glazing interior wall of the spacer includes a permeable region that gas-permeably connects a hollow chamber of the hollow main body to the interior of the insulating glazing.

6. The insulating glazing according to claim 5, wherein the glazing interior wall has, in the permeable region, at least one of one or more openings and a gas-permeable wall.

7. The insulating glazing according to claim 1, wherein the glazing interior wall includes, partially or in sections, a second gas-tight insulating layer that forms a gas-impermeable region.

8. The insulating glazing according to claim 7, wherein the gas-impermeable region lies between the pressure-equalizing body and a permeable region.

9. The insulating glazing according to claim 7, wherein the length of the gas-impermeable region along the circumferential spacer is at least 0.2 of the circumference of the spacer.

10. The insulating glazing according to claim 1, wherein the glazing interior wall includes a gas-tight wall that forms a gas-impermeable region.

11. The insulating glazing according to claim 1, wherein the hollow pressure-equalizing body is connected to the bore opening via a narrow portion the hollow pressure-equalizing body.

12. The insulating glazing according to claim 1, wherein the pressure-equalizing body contains a metal or a gas-tight plastic.

13. The insulating glazing according to claim 1, wherein the pressure-equalizing body contains at least one of aluminum, polyethylene vinyl alcohol (EVOH), lower density polyethylene (LDPE), biaxially oriented polypropylene film (BOPP), copolymers and mixtures thereof.

14. The insulating glazing according to claim 1, wherein the sealing material is formed as a cord.

15. A method for producing an insulating glazing with pressure equalization, comprising:

providing a spacer with a hollow main body having two parallel pane contact walls, an outer wall, and a glazing interior wall;

forming a bore opening through the outer wall of the spacer;

arranging the spacer together with an adhesive layer between a first pane and a second pane;

positioning a hollow pressure-equalizing body in or on the bore opening and between the first pane and the second pane, wherein a gas-permeable and vapor-diffusion-tight membrane is fastened in the hollow pressure-equalizing body;

forming a seal between an outer wall of the pressure-equalizing body and the bore opening; and filling with a sealing compound an outer pane intermediate space containing the hollow pressure-equalizing body and being between the first pane and the second pane.

16. The method for producing an insulating glazing of claim 15, further comprising positioning a removable stopper in the hollow pressure-equalizing body.

17. The method for producing an insulating glazing of claim 15, further comprising removing the stopper after filling the outer pane intermediate space with a sealing compound.

18. The method for producing an insulating glazing of claim 15, wherein forming a seal includes positioning a cord between the pressure-equalizing body and the bore opening.

19. A method of using an insulating glazing, comprising:

providing the insulating glazing of claim 1; and installing the insulating glazing in at least one of a building interior glazing, a building exterior glazing, and a façade glazing.

* * * * *